US008714244B2

(12) United States Patent
Conkle et al.

(10) Patent No.: US 8,714,244 B2
(45) Date of Patent: May 6, 2014

(54) STIMULATION THROUGH FRACTURING WHILE DRILLING

(75) Inventors: Don Conkle, Katy, TX (US); Ashley Johnson, Milton (GB); J. Ernest Brown, Cambridge (GB); Trevor McLeod, Calgary (CA); Matthew Miller, Cambridge (GB); Philip Sullivan, Bellaire, TX (US); Dean Willberg, Tucson, AZ (US)

(73) Assignee: Schlumberger Technology Corporation, Sugar Land, TX (US)

( * ) Notice: Subject to any disclaimer, the term of this patent is extended or adjusted under 35 U.S.C. 154(b) by 895 days.

(21) Appl. No.: 11/959,278

(22) Filed: Dec. 18, 2007

(65) Prior Publication Data

US 2009/0151938 A1 Jun. 18, 2009

(51) Int. Cl.
*E21B 49/00* (2006.01)

(52) U.S. Cl.
USPC ..... 166/250.1; 166/308.1; 175/50

(58) Field of Classification Search
USPC ..... 166/308.1, 250.1, 250.02; 175/50
See application file for complete search history.

(56) References Cited

U.S. PATENT DOCUMENTS

| | | | | |
|---|---|---|---|---|
| 2,783,026 | A | 2/1957 | Reistle, Jr. | |
| 3,529,665 | A * | 9/1970 | Malone | 166/264 |
| 3,578,078 | A | 5/1971 | Shilander | |
| 4,867,241 | A | 9/1989 | Strubhar | |
| 5,511,615 | A | 4/1996 | Rhett | |
| 6,427,530 | B1 * | 8/2002 | Krueger et al. | 73/152.46 |
| 6,435,277 | B1 | 8/2002 | Qu et al. | |
| 6,837,309 | B2 | 1/2005 | Boney et al. | |
| 6,981,560 | B2 * | 1/2006 | Nguyen et al. | 175/70 |
| 7,252,162 | B2 * | 8/2007 | Akinlade et al. | 175/72 |
| 7,380,600 | B2 | 6/2008 | Willberg et al. | |
| 7,493,948 | B2 | 2/2009 | Cooper et al. | |
| 2004/0206494 | A1 * | 10/2004 | Stephenson et al. | 166/250.1 |
| 2005/0167159 | A1 | 8/2005 | Bailey et al. | |
| 2005/0230107 | A1 * | 10/2005 | McDaniel et al. | 166/249 |
| 2006/0062084 | A1 * | 3/2006 | Drew | 367/68 |
| 2007/0284106 | A1 * | 12/2007 | Kalman et al. | 166/298 |
| 2008/0108524 | A1 * | 5/2008 | Willberg et al. | 507/225 |

FOREIGN PATENT DOCUMENTS

EP 0718641 A2 6/1996

OTHER PUBLICATIONS

Carman "Fluid flow through granular beds", Transactions of the Institution of Chemical Engineers, vol. 15, 1937, pp. 150-166.

(Continued)

*Primary Examiner* — Jennifer H Gay
*Assistant Examiner* — Elizabeth Gitlin

(57) ABSTRACT

A method for preparing a formation surrounding a wellbore to bear hydrocarbons through a borehole is disclosed. In one step, a bottomhole assembly is inserted into the borehole. The formation is drilled with the bottomhole assembly. The formation may be characterized with logging tools, probes, sensors, seismic system and/or the like to create first information. One or more fractures are placed in the formation without removal of the bottomhole assembly from the wellbore. Further, continuous drilling of the formation is performed with the bottomhole assembly after/during placing the fractures. Further characterizing of the formation with the probes, sensors/systems or the like is performed to produce second information. Another fracture is placed with feedback from the second information. Repeating the drilling, characterizing and placing of fractures as necessary during the formation preparing process.

19 Claims, 4 Drawing Sheets

(56) References Cited

OTHER PUBLICATIONS

Hewett et al. "Induced stress diversion: a novel approach to fracturing multiple pay sands of the NBU field, Uintah Co, Utah", SPE Rocky Mountain Regional/Low-Permeability Reservoirs Symposium and Exhibition, Denver, Apr. 5-8, 1998, SPE 39945.

Martins et al. "Tip screenout fracturing applied to the Ravenspum South gas field development", SPE Production Engineering, Aug. 1992, pp. 252-258 (paper first presented at the SPE Annual Technical Conference and Exhibition, San Antonio Oct. 8-11, 1989, SPE 19766).

Smith et al. "Tip screenout fracturing: a technique for soft, unstable formations", SPE Production Engineering, May 1987, pp. 95-103 (paper first presented at the SPE Annual Technical Conference and Exhibition, Houston, Sep. 16-19, 1984, SPE 13273).

Patent Cooperation Treaty, "International Search Report", dated Aug. 4, 2009, 3 pages.

* cited by examiner

STIMULATION THROUGH FRACTURING WHILE DRILLING

BACKGROUND

This disclosure relates in general to drilling and, but not by way of limitation, to fracturing while drilling.

The overall process of creating a wellbore for hydrocarbon production—which may comprise drilling a well, running a casing in the drilled well, cementing the casing, perforating the casing and stimulating/fracturing the productive intervals of the well—may be performed in three steps—drilling, casing and stimulating/fracturing. Each of the processes are generally performed independently of each other with different groups of engineers etc. having responsibility for each of the steps. Performing the various wellbore creation steps separately is time intensive and expensive.

SUMMARY

Fracturing while drilling can seed creation of a wellbore that may yield hydrocarbons, for example. Through feedback and/or monitoring, the location of fractures in the formation may be closely controlled. Downhole tools, seismic monitoring systems and/or the like may allow for monitoring fractures. Information from that monitoring may be used to modify how the fracturing is performed. Tracers, proppants, casing and other techniques can be optionally used to control formation of the fractures in various embodiments.

In one embodiment, the present disclosure provides a method for preparing a formation surrounding a wellbore to bear hydrocarbons through a borehole. In one step, a bottomhole assembly is inserted into the borehole. The formation is drilled with the bottomhole assembly. The formation may be characterized with logging tools on the bottomhole assembly, sensors and/or probes on the bottomhole assembly, seismic monitoring tools or the like positioned at the surface or away from the bottomhole assembly to create first information. One or more fractures may be placed in the formation without removal of the bottomhole assembly from the wellbore. Further drilling of the formation may be performed with the bottomhole assembly after placing the fractures. Further characterizing of the formation with the logging tools, sensors, probes, seismic systems and/or the like may be performed to produce second information. Another fracture(s) may be placed with feedback from the second information. Repeating the drilling, characterizing and placing of fractures as necessary during the formation preparing process. In certain aspects, the bottomhole assembly may be removed from the wellbore after repetition of this process.

In another embodiment, the present disclosure provides a method for preparing a formation surrounding a wellbore to bear hydrocarbons. In one step, the wellbore is drilled with a bottomhole assembly. Pressure is increased for a fluid in at least a section of the wellbore while the bottomhole assembly is in the wellbore. The formation is fractured appurtenant to the wellbore to create one or more fractures. The one or more fractures are analyzed. A proppant is applied to the fracture. Further fracturing is performed to create another fracture based upon the analysis. The wellbore is drilled with the bottomhole assembly, wherein the fracturing, analysis and drilling are performed in an iterative manner without pulling the bottomhole assembly out of the wellbore.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment. It being understood that various changes may be made in the function and arrangement of elements without departing from the spirit and scope as set forth in the appended claims.

Figure 1:
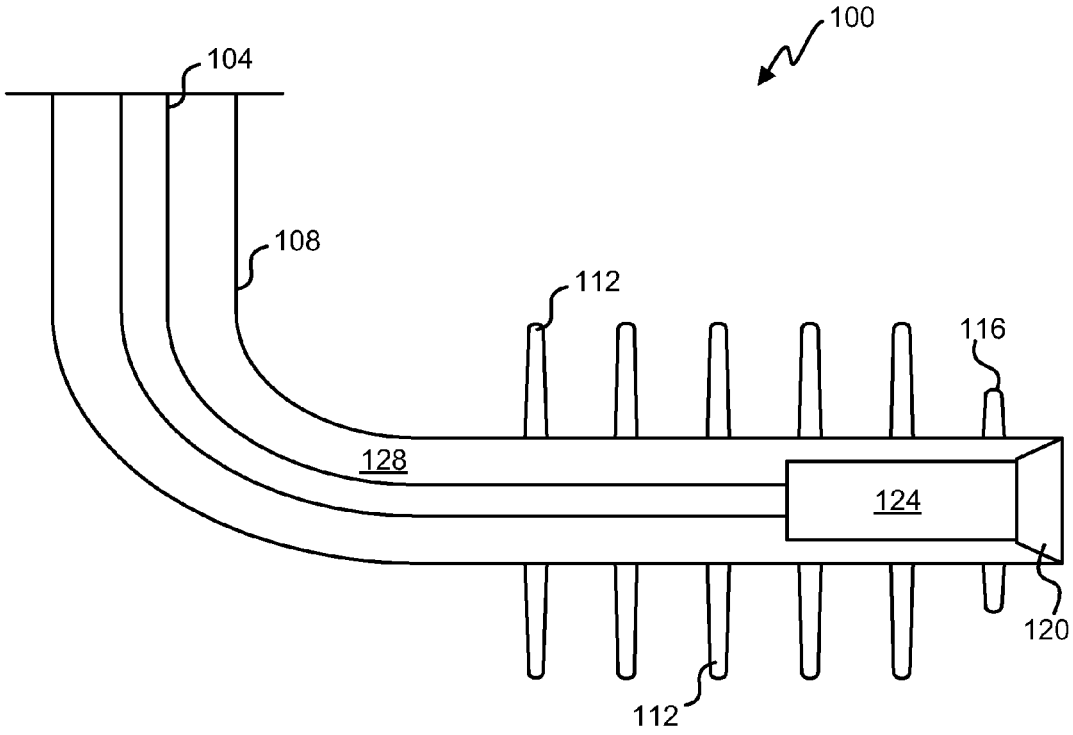
FIG. 1 depicts a diagram of an embodiment of a system showing fracturing while drilling.

Referring first to FIG. 1, a diagram of an embodiment of a system 100 showing fracturing while drilling in cross-section. A drill pipe 104 extends from a borehole into the formation. The wellbore may be completely or partially enforced with casing 108. The casing 108 may be added to the wellbore without removal of the bottomhole assembly 124 in some embodiments.

A bottomhole assembly 124 is coupled to a drill bit 120 to further extend the wellbore when the bit 120 rotates. The drill bit 120 may have jets, explosive charges and/or mechanical cutters to perforate the formation and/or create points of weakness in the wellbore to help initiate fractures at a specific location. Drilling fluid can be pumped down the drill pipe 104 and through the bottomhole assembly 124 and/or bit 120. Additionally, fracturing fluid and/or proppant fluid can be pumped through the drill pipe 104 and/or annulus 128.

This embodiment creates fractures in the formation to enhance extraction of hydrocarbons. Shown are growing fractures 116 and propped fractures 112. The propped fractures 112 are sealed from the pressure being used to complete the growing fracture(s) 116. Once the growing fracture(s) 116 is complete, the growing fracture(s) 116 is sealed with a proppant as the bit 120 progresses through the formation far enough to warrant another fracture cycle.

In embodiments of the present invention, two or more of the wellbore creation steps/processes are combined into a single process. More specifically, but not by way of limitation, in an embodiment of the present invention the drilling of the wellbore may be combined with the whole or a part of the stimulating process. In an embodiment of the present invention, methods and systems are provided for fracturing while drilling ("FWD"). FWD may provide for, among other things, significant time and operational savings. Such consolidation may become even more advantageous when numerous intervals in a wellbore or wellbores may need to be stimulated as each individual treatment/process may be a major operational process. Embodiments of the present invention may be combined with different drilling techniques, stimulation techniques and the like.

In an embodiment of the present invention, fracturing of a formation surrounding a wellbore may be provided while a bottomhole assembly ("BHA") 124 that is used to drill the wellbore is still in the wellbore. Specifically, the BHA 124 is the lower portion of the drillstring, including (from the bottom up in a vertical well) the bit, bit sub, an optional mud motor, stabilizers, drill collars, heavy-weight drillpipe, jarring devices ("jars"), crossovers for various threadforms, directional drilling and measuring equipment, measurements-while-drilling tools, logging-while-drilling tools and/or other specialized devices. For purposes of this description, the term BHA 124 may refer to any assembly 124 used to drill the wellbore. The BHA provides force for the bit to break the rock formation with weight on bit, survive a hostile mechanical environment and provide the driller with directional control of the well. The BHA 124 may comprise a conventional drill bit, an electromagnetic drill bit and/or the like. As such, the BHA 124 is not tripped out prior to commencement of the fracturing/stimulation, consolidation, lining, and/or casings processes in various embodiments.

A fluid under pressure may be used in the wellbore to provide for the fracturing. The fluid may be applied to the formation through a coiled tube, down a pipe in the wellbore, through the wellbore, through an annulus 128 of the wellbore and/or the like. The fracturing fluid may include one or more proppants to maintain the fractures 112 that are created in the fracturing process. The pressurized fluids may be used for fracturing while the BHA 124 is in the wellbore, and the pressurized fluids may be used while the BHA 124 is being used to drill the wellbore. The pressurized fluid may comprise a drilling fluid or some other specialized fluid.

In very tight formations, sometimes called unconventional reservoirs, the hydrocarbons may be trapped in a matrix with a very low permeability. These unconventional reservoirs may include coal bed methane and shale gas formations, for example. Typically, these reservoirs may be drained through fractures 112 ("fracs"), either naturally occurring fractures or stimulation fractures 112 added in a stimulation/fracturing process. However, to drain the matrix through the fracs can take an undesirably long time if the fractures are not closely spaced. Simulations have shown that it may take decades to drain a 10 foot cube of rock, for example.

To improve recovery from unconventional-type formations, certain embodiments of the present invention may be used to place closely spaced conductive pathways across the entire formation. Unlike conventional fracturing techniques, the FWD methods and systems of the present invention may provide for placement of the fractures 112, isolation of the fractures 112 from the parent wellbore, etc. as will be further explained below.

In embodiments of the present invention, fractures 112 may be placed during the drilling phase of the well construction. Fracturing during the drilling phase may comprise fracturing a wellbore that is in the process of being drilled, that is not completely drilled, from which the BHA 124 has not been tripped, after drilling has completed, and/or the like. Creating fractures 112 while the well is being drilled may provide for closer spacing of the fractures 112. This may be provided because each fracture in an embodiment of the present invention may be placed in a newly drilled section along the well. Isolation of existing fractures 112 may be achieved by in-situ stress diversion, hydraulic isolation with selective fracturing fluids, and/or the like.

In an embodiment of the present invention, using fluid selection or the like, the fluid loss from the wellbore down the conductive fractures 112 may be managed to maintain fluid in the wellbore such that fluid leak-off down the newly created fracture can be limited. Fluid selection may comprise selecting properties of the fluid, controlling properties of the fluid, adding additives to the fluid and/or the like as further explained below. In certain aspects, through formation selection, the tightness of the formation may provide for only small fluid loss to the matrix.

In an embodiment of the present invention, a formation may be fractured just behind a drill bit 120 or the like. The drill bit 120 may be drilling the wellbore or not drilling the wellbore when the fracture is placed in the drill bits vicinity. Rotation of the drill bit 120, accessories to the drill bit 120 or the like may be a part of the fracturing process. Repeat fracturing may be provided for every few feet as the hole/wellbore is being drilled. Wellbore strengthening, such as plastering materials on the formation face, consolidating a layer on the formation around the wellbore etc. may provide for strengthening of the wellbore during the fracturing while drilling process. In various embodiments, jet fracturing, fluid pressure fracturing and/or explosive fracturing may be used. The initiation of fractures 112 can be controlled from the surface.

In certain embodiments of the present invention, steps may be taken to ensure that sequential fractures 112 are made separately from one another, rather than refracturing in the same location. When a propped fracture closes there may be an increase in local stress levels, which may encourage future fracs to other lower stress zones. This effect is called in-situ stress diversion and may be a property included/accounted for in the fracturing in accordance with an embodiment of the present invention.

In an embodiment of the present invention, fracturing may occur in a wellbore that is in the process of being drilled. The drilling may be stopped or may occur in conjunction with the fracturing. In some embodiments of the present invention, fluid pressure in an incompletely drilled wellbore may be increased to provide for fracturing. To encourage fractures 112 to start, perforations in the bore walls with propellant, mechanical cutters or jetting can be used. In certain embodiments, a proppant may be used to keep the fractures 112 open. In certain aspects of the present invention, the drilling fluid may contain the fracturing fluid and/or proppant. In such aspects, the pressure of the circulating drilling fluid containing the fracturing fluid and/or proppant may be controlled to provide for fracturing of a formation appurtenant to the wellbore being drilled. In other aspects, the fracturing fluid and/or proppant may be applied to the formation via an annulus 128 of the wellbore. In yet other aspects, a secondary wellbore, coiled tubing, a pipeline or the like may be used to deliver the fracturing fluid and/or proppant to a section of the wellbore or the like to fracture the formation around the wellbore being drilled. In certain embodiments, the drilling may be suspended and the fracturing fluid and/or proppant may be applied to the formation and then drilling may resume without tripping the BHA 124. The fracturing fluid and/or proppant may be pumped down the wellbore or pumped/applied to certain sections of the wellbore being drilled.

In an embodiment of the present invention, a system and method is provided for generating and/or monitoring placement of fractures 112 during the drilling phase of the well construction. In such an embodiment, isolation of the fractures 112, fractured zones and/or the like may be provided, whereby existing fractures 112 may be unlikely to reopen due to such things as the in-situ stress diversion effect or the like. Further, in such an embodiment, undrilled zones may maintain existing isolation. As such, embodiments of the present invention may provide for placing multiple sequential fractures 112 along the wellbore. The multiple sequential fractures 112 may in some embodiments of the present invention be closely spaced and provide for high conductivity between the wellbore and the reservoir even in tight formations. In an embodiment of the present invention, fractures 112 may be placed every few feet along the target formation.

Merely by way of example, in very tight formations, such as the Barnet or Antrum Shales or the San Juan or Powder Wash Coalbed Methane reservoirs, where hydrocarbons may be trapped in the matrix with a very low permeability, the drainage depth of fluid from the matrix may be very short. For these types of formations, placing closely spaced high conductivity pathways across the entire formation may improve conductivity. Conventional fracture stimulation may be used to form these pathways in the formation, but placement and isolation while fracturing ("fracing") of these fractures 112 from the parent wellbore may be difficult and time consuming.

In an embodiment of the present invention, a system and method is provided for generating and monitoring placement of fractures 112 during the drilling phase of the well construction. In such an embodiment, isolation of the fractures 112, fractured zones and/or the like may be provided, whereby new fracs may be created such that existing fracs may be unlikely to reopen due to such things as the in-situ stress diversion effect, zonal isolation or the like. Further, in such an embodiment, undrilled zones may maintain existing isolation. In an embodiment of the present invention, fractures 112 may be placed every few feet along the target formation.

In some embodiments of the present invention, the drilling method may involve drilling with a drilling fluid that may also be used as a fracturing fluid. In certain embodiments, the fracturing fluid may be pumping down the annulus 128 of the wellbore to fracture the formation.

In certain embodiments of the present invention, effectuation of the FWD process may depend upon the control of fluid losses throughout the drilling and fracturing phases. In certain aspects, fluid loss may be addressed by use of WARP-type solids or polymers and/or the plastering and/or wellbore strengthening processes. WARP Advanced Fluids Technology and the like are technologies produced by M-I L.L.C. of Houston, Tex.

In one embodiment of the present invention, a network of closely spaced fractures 112 may be provided in the formation surrounding a wellbore. In an embodiment of the present invention, the fracturing of the formation may be performed at the same time the wellbore is being drilled. In such an embodiment, the formation may be fractured at, or close to, the drill bit 120. The fracturing may be repeated every few feet as the wellbore is being drilled.

In certain aspects, the drilling and fracturing method of the present invention may be used for low permeability formations and the resultant fractures 112 may be propped with a low permeability proppant. A differential in permeability in the formation and the proppant may provide for conductivity through the fracture into the wellbore. Embodiments of the present invention may provide for benefits in terms of reservoir drainage, operational efficiency, time and trips to location.

In certain embodiments of the present invention, as the well is drilled and sequentially more fractures 112 are generated, the fractures 112 may be distributed along the well, and not just in a single section. In such embodiments, a description of the rock characteristics, the in-situ stresses and/or the pore pressure may be processed to provide for planning and/or controlling the distribution of the fractures 112. Processing and characterization of an Induced Stress Diversion ("ISD") effect and how new fractures 112 form and grow close to existing fractures 112, may also provide for controlling the drilling and fracturing method of the present invention to provide for the distribution of the fractures 112. In certain embodiments a processor or the like may provide for real time management of the FWD with feedback and outputs provided. In certain embodiments of the present invention, because the ISD may be a function of the fluid loss, by selecting the level of fluid loss through the existing closed fractures 112, fracture separation may be controlled.

In an embodiment of the present invention, drilling fluid and/or mud circulation rates in the wellbore may be controlled to provide a pressure in the wellbore that may be provided above or below the frac pressure for the formation. By controlling the circulation of the drilling fluid, mud and/or the like to provide for pressures above the frac pressure, simultaneous or essentially simultaneous drilling and fracturing may be provided in an embodiment of the present invention. Further, by controlling the circulation and/or pressure developed by the drilling fluid, mud or the like or a fluid used in the wellbore during the drilling process, the formation or a section of the formation surrounding the wellbore may be fractured at the same time the wellbore is drilled. This fracturing may provide fractures 112 into the formation beyond the casing 108, cement or the like of the wellbore and penetration into the formation. These fractures 112 may provide for stimulation of a reservoir associated with the earth formation.

In certain embodiments of the present invention, a processor and or the like may be coupled with a source of the drilling fluid, mud and/or fluid used for fracturing at the same time as drilling, and may control the circulation of the drilling fluid, mud and/or fluid used for fracturing at the same time as drilling. The processor may manage the fracturing and/or drilling processes. In certain aspects, pressure sensors in the wellbore and/or the earth formation may provide feedback/information/data to the processor. In a loop of activity, fracturing can be done, sensing can be performed to see if the fractures 112 are adequate, sealing of the fractures 112, movement of the BHA 124 deeper into the formation, where after fracturing is done again as the process starts to repeat. Once the drilling is done, the sealing can be removed to allow the hydrocarbons to flow out the wellbore. In some embodiments, the sealing fluid is incorporated in the fracturing fluid.

In some embodiments of the present invention, sensors associated with the drill bit 120, the casing 108, the drill string and/or the like may provide data/feedback to the processor. In certain aspects, as well as control of circulation of the drilling fluid, mud and/or fluid used for fracturing at the same time as drilling other methods of pressure control in the wellbore may be used to provide for fracturing while drilling and/or controlling the amount/intensity of the fracturing while drilling. The processor may be connected with other sensors, such as optical sensors, seismic sensors and or the like to provide for knowledgeable control of the FWD process. Moreover, the drilling of the wellbore may be changed—i.e. depth, angle, orientation or the like of the drilling—in response to the fracturing and/or results of the fracturing of the formation as the wellbore is drilled. As such, the process may provide for a drilling process that is controllable in response to fracturing of the formation.

In certain aspects of the present invention, the pressure in the drill pipe 104 at various locations may be measured. The pressure measurements may be processed to provide for controlling the fracturing and/or the drilling of the fracturing while drilling process. In other aspects, a logging while drilling tool on the BHA 124 may be used to acquire data while performing the FWD operation. In one embodiment of the present invention, a real time bottomhole pressure may be used in the FWD process to provide feedback on when to stop or curtail the fracturing process.

In some aspects of the present invention, liners, the cement, the casing 108 and/or the like of the wellbore may be configured to provide for channeling/localizing/distributing the fracturing process during the drilling of the wellbore. The BHA 124 would remain down hole during the channeling/localizing/distributing process.

In some embodiments of the present invention, data fracs or the like may be provided through the drill string. Such a data frac, may be a fluid tagged with a tracer, such as a radioactive tracer, may provide for tracking the frac inside or outside of the wellbore using a detector, such as a gamma ray detector or the like. In such embodiments, if it is found from the detector that the fracture is not going in a preferred direction, is going on top of a previous fracture and/or the like, the situation may be corrected by pumping a diverting agent, drilling further, drilling in a different direction and/or the like. Additionally, in one embodiment of the present invention, a logging while drilling ("LWD") tool may be used to determine the direction of the fractures 112. From this information, the plane of minimum stress from one fracture to the next may be determined and in certain aspects, the plane of minimum stress may be optimized during the FWD.

In another embodiment of the present invention, microseismic fracture monitoring of the FWD process may be performed. In certain aspects, the microseismic fracture monitoring of the FWD process may provide for calibrating a Hydraulic Fracture Monitoring ("HFM") system used in the FWD process. In certain embodiments of the present invention, one or more tilt-meters may be used with the FWD system or method.

In one embodiment of the present invention, fracture wave interpretation may be used as a method for estimating the fracture length during the fracturing process of the FWD. In such an embodiment, an excitation signal (pressure pulse, water hammer or the like) may be used to resonate or the like the fracture and reflected signals or the like from the fracture may be detected and/or processed.

In another embodiment of the present invention, tracers, such as chemical, isotopic, radioactive tracers, DNA fragments and/or the like may be used in the fracturing fluid and/or the proppant and they may be monitored in real time and/or after a section of wellbore has been drilled and fractures 112. The tracers may be monitored with a logging tool, a logging tool mounted on the BHA 124, a wellbore tool and/or the like to provide for analysis of the fracturing process of the FWD. In certain aspects, LWD may be used to detect where a fracture is disposed in the wellbore immediately the fracture has been placed or even while the fracture is being created/pumped. Different tracers may be placed in different fractures 112 and each may be monitored during a clean-up operation to manage the clean-up operation and identify which fractures 112 are contributing or are a source of a liquid etc. at issue in the clean up.

In one embodiment, hydrophones are used to monitor flow rate in the annulus 128. Acoustic readings can be used to determine where flow is going in the annulus 128. For example, a point with lower flow could indicate that there are fractures 112. There may be several hydrophones spaced along the pipe of the drill string for these measurements. Another embodiment uses resistivity of the formation to determine where to fracture.

An element in the fracturing process is the delivery of hydraulic power to the fracture location. In certain embodiments of the present invention, the delivery of the hydraulic power for the fracturing while drilling may be provided down the drill pipe 104, through the BHA 124, down the annulus 128 and/or the like. In certain aspects of the present invention, the fracturing of the FWD may be initiated by pumping down: (a) the drillpipe with the annulus 128 closed in; (b) the annulus 128 with the drillpipe closed in; or (c) both the annulus 128 and drillpipe simultaneously. Zone isolation techniques, such as the use of packers or the like, and/or the like may provide for delivering hydraulic power to a section of the wellbore where the fracturing is desired.

In some embodiments of the present invention, a variety of downhole fracture enhancers may be used to direct the fracturing mechanism. In one embodiment, all pathways in and/or into the wellbore may remain open at the surface, but a downhole choke may be activated to create local overpressures and fracturing. Merely by way of example, vanes may be disposed close to the drill bit 120 that rotate against the flow of fluids close to the drill bit 120 to prevent and/or reduce circulation of fluids close to the drill bit 120 and, as a result, may induce fracturing. In other aspects, a bladder may be used that inflates in the wellbore and reduces circulation of fluids in the wellbore to precipitate fracturing. In other aspects, a plurality of vanes may be used that may align or misalign and may create locally high overpressures. In yet other aspects, a coil frac type cup may be disposed in the annulus 128 and may be activated electrically, by pressure, by flow rate and/or the like to provide for isolating the annulus 128 and/or a section of the annulus 128 and in so doing, to generate a fracture pressure. In still further aspects, a non-return valve may be disposed in the drill string, whereby when circulating down the drill pipe 104 the valve may be opened to provide for full return flow, but when circulating down the annulus 128 the valve may be closed to provide for generating fracturing pressure. A bypass valve may be disposed at the top of the BHA 124 to provide protection for the BHA 124 from the high flow rates of fluid, while fracturing is occurring.

In FWD, the first fracture may initiate along the wellbore at the location of the lowest principal stress and lowest rock strength. The fracture may be initiated and pumped as discussed above. As the drilling process then continues, and the next fracture location is penetrated, the fracturing process can be re-initiated. To insure that the second fracture will not return to the original fracture location, in an embodiment of the present invention, the first fracture may be overstressed. This may happen if the fracture is propped open. The wider the propped fracture, the higher the localized increased stress will occur. As such, propping of the fracture may be controlled to provide for overstressing. The spacing of the fractures 112 may be influenced not only by width but also fracture length and the fractures 112 may be placed so that the new fracture will initiate in a location where it no longer feels the increased stress of the previous fracture.

In some embodiments of the present invention, a tip screenout ("TSO") treatment may be performed in the first fracture that may greatly increase fracture width and therefore the localized stress. To insure that TSO is achieved, the slurry design may incorporate the use of fibers. In certain aspects, dissolving or degrading fibers may be heavily loaded towards the end of the treatment at relatively high loadings to help initiate a screenout. This might provide for stabilizing the proppant pack and also temporarily reducing the overall proppant permeability. In certain aspects, this process may be repeated numerous times without having to retrieve the bottomhole drilling assembly 124.

In some aspects of the present invention, diversion pills, such as a pill of J579 (i.e., polylactic acid fibers), may be used to create temporary, but very low permeability filter cakes. Graded calcium carbonate may also be combined with polymer in some aspects. In some embodiments, drilling mud, drilling fluid and/or the like may include fibers or some other fluid loss type material to minimize internal filtercake damage to the proppant pack. Alternatively, a proppant pack that is not permeable initially, similar to a WARP fluid, may be used in an aspect if the present invention.

In instances of the present invention, it may be necessary to lower the fracture initiation pressure at a specific location to insure that a fracture is created in this location. In an embodiment of the present invention, this may be done by perforating or notching the borehole wall. In certain aspects, a notch may be abrasively jetted along the borehole—the notch may be aligned with the maximum principal stress direction. The jet may be part of the bit 120, the drilling steering system and/or the like. In other aspects, an under-reamer may be activated in the specific sections where initiation of the fracture is desired. In further aspects, the drilling may be stopped, but the bit 120 may be used to machine a larger hole, used to roughen the hole surface, roughen a section of the formation and/or the like to provide for initiation of the fracture.

Perforating is sometimes done on a casing 108 of the wellbore. Alternatively, the perforating can be done where there is nothing protecting the wellbore to encourage a fracture where the perforation is made. The perforated positions in the casing 108 can be the focus of fracturing effort. Perforating can be done with jetting, shaped explosive charges and/or mechanical cutters. The shaped charges would be in a carrier of the BHA 124 typically behind the bit 120. A signal could be used to selectively activate one or more of the shaped charges. Once the perforation is made, fracturing fluid can be pumped down the drill string and/or annulus 128 to create a pressure that will expand the perforation into a fracture.

In some cases, such as in the presence of natural fissures or fractures which cross the borehole at some indiscriminate angle where fluid losses may significantly increase, it may be difficult to place the fracture near the toe of the recently drilled borehole. In such cases, the fracturing process may move back up-hole through the annulus 128 to the area of high losses. To prevent this, in certain aspects of the present invention, a downhole fracture enhancer such as a sealing mechanism may be placed in the annulus 128 to prevent flow back up hole while the fracturing process is taking place. In such aspects, a re-settable packer, a viscosified fluid, a particle pack (which may be made from proppant) and/or the like may be used as the sealing mechanism.

In one embodiment, fracturing takes place coextensive in time with the drilling. The BOP can be sealed off and fracturing fluid pumped down the annulus 128. The drill bit 120 could be slowed during this process or kept at full speed. Additionally, there could be cycles of fracturing and not fracturing as drilling through the formation progresses. The amount of time fracturing could be interrupted with the normal flow with drilling fluids.

In one method according to an embodiment of the present invention, the zone desired to be fractured may be fatigued. In such a method, a confined zone of the earth formation appurtenant to the wellbore being drilled may be packed with propellant and which may then be ignited. This may provide for reducing breakdown pressures. In certain aspects, the combustion of the propellant may be confined to a small portion of the borehole. The borehole includes the wellbore, which includes the openhole or uncased portion of the well. The borehole may refer to the inside diameter of the wellbore wall, the rock face that bounds the drilled hole. Merely by way of example, the combustion may be limited to a range of the order of a meter. Controlled combustion of propellant may provide for locally promoting fracture breakdown.

In other aspects, mechanical shields, energy absorbing materials (foam pills, hollow glass spheres, or the like) and/or the like may be used to confine a pressure spike(s) associated with preparing the earth formation for fracturing. In this way, the "blast shields" placed adjacent to the blast may prevent damage from spreading beyond the intended zone. In yet other aspects of the present invention, different source of energy other than combustion sources, such as water hammers or the like, may be used to provide for breakdown/preparation of the earth formation.

In an embodiment of the present invention, when producing the well, fractures 112 may conduct the produced fluid from the matrix to the wellbore so the permeability may be high compared to the matrix permeability. However during the drilling/fracturing operation, it may be desirable that fluid loss through the fractures 112 may be reduced. In accordance with certain embodiments of the present invention, fluid loss may be controlled by pumping a proppant slurry into the fracture(s) in the well, where the proppant has a permeability that may change over time, on demand and/or the like. In such embodiments, the proppant pack may not be highly permeable during the drilling process, but may develop a high permeability before the well is put on production. Merely by way of example, materials such as polylactic acid, polyglycolic acid and polyvinyl alcohol may be placed as solids that will hydrolyze over time at certain temperatures to non-damaging liquids. Other materials, such as sized calcium carbonate, may be used and may be dissolved when required by an acid or the like. Waxes may be used in the proppant pack to provide for a solid material that may be melted at a given temperature into a flowable liquid.

In certain aspects, minimization of flow down the fracture may be provided by placing an effective filtercake across the opening of the fracture along the borehole. The filtercake may be configured to quickly form as fluid is squeezed into the fracture itself. To minimize fluid damage from deep penetration into the fracture, a robust filter cake may be plastered across the face of the fracture using jetting technologies or the like. In embodiments of the present invention, the fracturing fluid used in this type of stimulation could range from fracturing fluids that may be used in conventional fracturing methods, such as polymeric (Guar, derivatized guar, HEC, derivatized HEC, polyachrylamides, etc.) and their analogous crosslinked systems (borates, zirconates, titanates, aluminates, antimonates, etc), foams (either $CO_2$ or $N_2$), viscoelastic surfactants, metal associated-phosphate ester gelled oils, oil and water emulsions or frac oils or water.

Fracturing fluids placed into formations with ultra-low permeability, unconventional shale or coal or the like, generally have very high efficiencies when looking at the rock matrix itself. In such fluids, the spurt of the fracturing fluid may be zero and the fluid loss coefficient may be extremely low when considering the bulk matrix. The majority of fluid leakoff may take place down fractures 112, fissures or vugs where there is whole fluid leak off. Base fluid leakoff is sufficiently low across the bulk matrix reservoir rock that the formation of a filter cake will not take place.

For very tight formations, a system or method of the present invention may be tolerable to the fluid loss. Merely by way of example, a completed well may produce 2000 barrels per day ("BPD") with a drawdown of 50 psi. In such an example, operating below the fracture opening pressure without a filter cake may provide a fluid loss of 4000 BPD with an over pressure of 100 psi. In an embodiment of the present invention, a drilling system 200 may be run at around 400 gpm (14,400 BPD) resulting in a significant, but tolerable, fluid loss.

In some embodiments, the drilling method of the present invention may comprise air, nitrogen and/or the like drilling. Merely by way of example, in certain aspects, the air drilling may be combined with fracturing with a water based fluid, a foam, pure nitrogen and/or the like. In such an example, water and gas production while drilling may help with the cleanup of these formations.

In certain embodiments of the present invention, the drilling may be underbalanced and the wellbore being drilled may be producing one or more hydrocarbons while the FWD is occurring. In some embodiments of the present invention, the FWD may comprise drilling with one or more fracturing fluids. In other embodiments or in combination with the foregoing, wellbore strengthening processes, including wellbore plastering, wellbore plastering in casing drilling, and the like may be used in the FWD.

In certain embodiments of the present invention, concentric tubing may be used to supply different fluids to different zones down the wellbore/formation and may provide for protect certain sections from damaging pressures. In such embodiments, the use of concentric annuli may provide for reducing circulation time, fluid mixing and contamination, overall fluid volumes, and may reduce operation time, fluid costs and/or the like.

Figure 2:
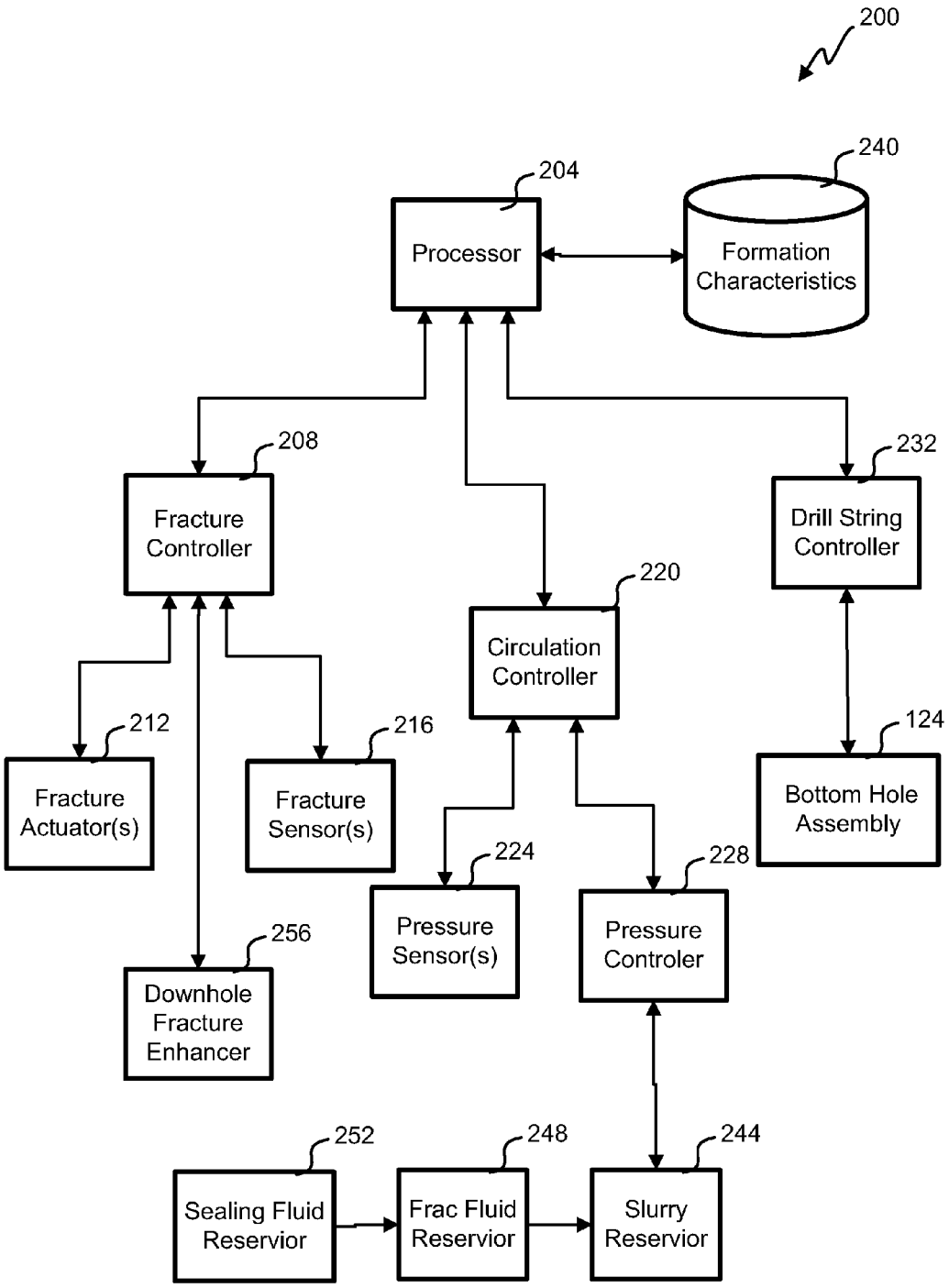
FIG. 2 depicts a block diagram of an embodiment of a drill control system.

Referring next to FIG. 2, a block diagram of an embodiment of a drill control system 200 is shown. A processor 204 has access to a database 240 with formation characteristics. With the formation characteristics, the processor can control how to create fractures, circulation of fluids and the drill string. This embodiment further breaks-up management tasks into a fracture controller 208, a circulation controller 220 and a drill string controller 232, but it is to be understood that these functions could be combined or distributed in any way.

The drill string controller 232 manages the bottomhole assembly 124. This may include actuation of the drill bit, opening valves, removal and insertion of the drill string, etc. Circulation and fracturing efforts are coordinated with the action taken by the drill string controller 232. In some embodiments, the drill string controller 232 can record or initiate casing of the wellbore and other tasks.

A fracture controller 208 is involved in creating fractures in the formation. There are various downhole fracture enhancers 256 described throughout this description, for example, valves and vanes that are managed by the fracture controller. A fracture actuator 212 can initiate the fracture formation by whatever mechanisms are available, for example, valves to create pressure, explosive charges or perforation mechanisms. The fracture controller 208 can monitor how the fracturing process is operating with various fracture sensors 216 described elsewhere in this description. This feedback can be used to control when fracturing should end and move to the next position in the wellbore.

The circulation controller 220 manages the various fluids used in the drill control system 200. Pressure sensors 224 are used below and/or above ground to monitor how the various fluids are being used. A pressure controller 228 can regulate how the various drilling, frac, proppant, and sealing fluids are used. These may be separately applied, mixed together or multi-purpose in various embodiments. The drilling fluid is held in a slurry reservoir 244 and coupled to a frac fluid reservoir 248 and a sealing fluid reservoir 252. The fracture actuator 212 may signal the circulation controller 220 to manipulate the fluids to fracture the formation.

Figure 3A:
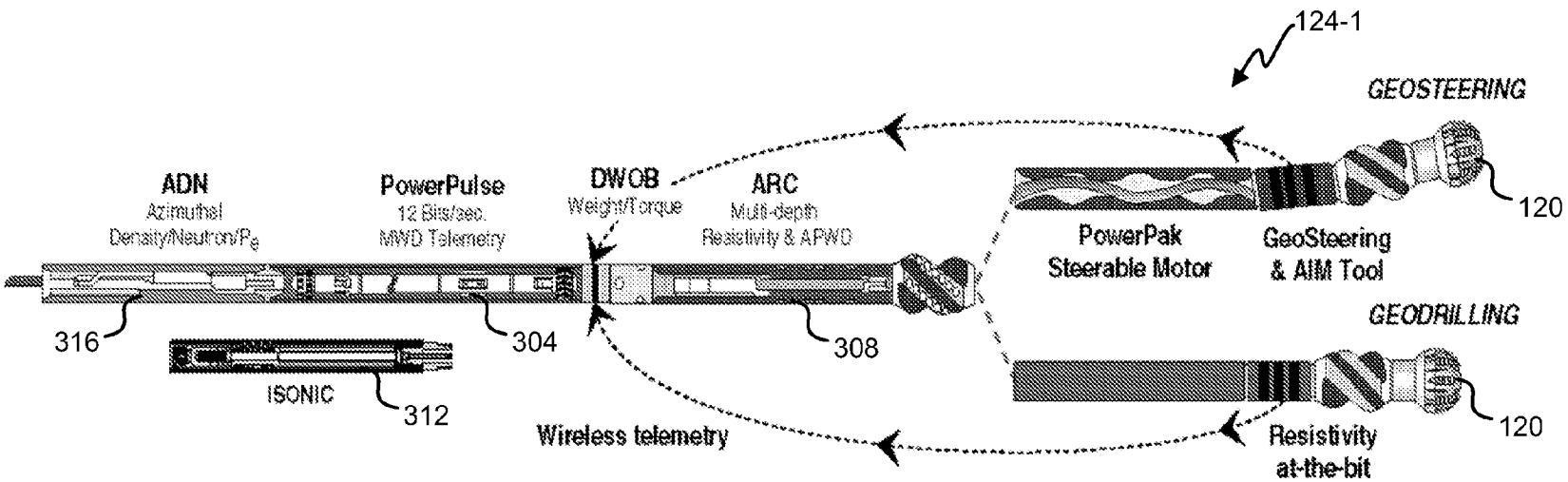
FIGS. 3A and 3B depict diagrams of embodiments of bottomhole assemblies.
Figure 3B:
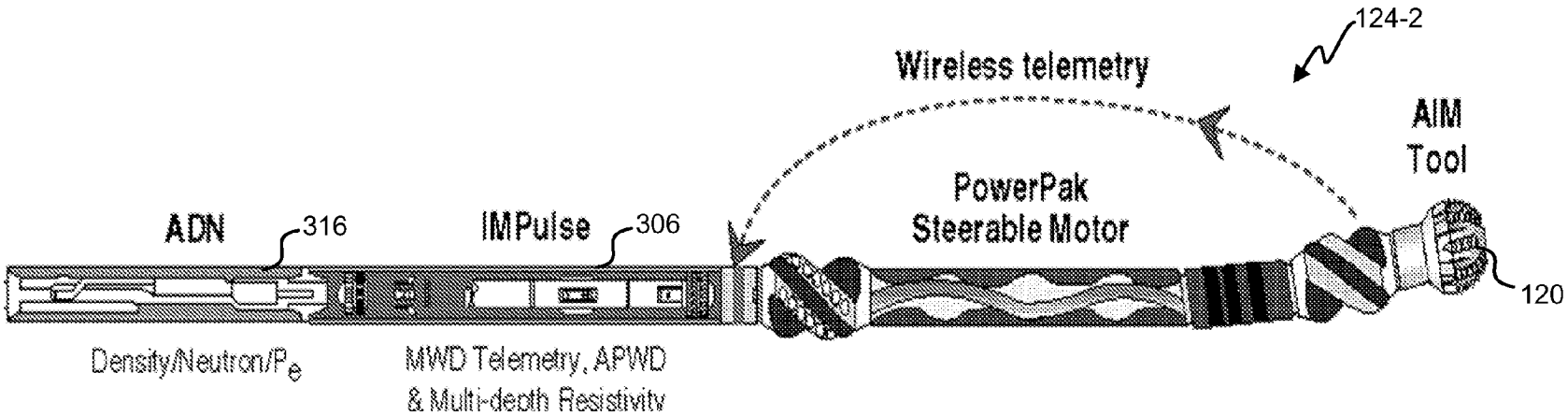

Referring next to FIG. 3A and FIG. 3B, a drawing of embodiments of BHAs 124 that perform both logging while drilling ("LWD") and monitoring while drilling ("MWD") are shown. The first embodiment of the BHA 124-1 in FIG. 3A is designed for a 12.25 inch and 8.5 inch hole, and the second embodiment of the BHA 124-2 of FIG. 3B is designed for a 6 inch hole. The first embodiment of the BHA 124-1 shows alternative ends, with one for geosteering and the other for geodrilling. Geosteering is accomplished using a steerable motor.

MWD tools that measure formation parameters (resistivity, porosity, sonic velocity, gamma ray) are referred to as LWD tools. LWD tools use similar data storage and transmission systems, with some having more solid-state memory to provide higher resolution logs after the tool is tripped out than is possible with the relatively low bandwidth, mud-pulse data transmission system. MWD uses wireless or wired communication to gather information from the LWD tools and relays that telemetry to the surface.

LWD allows the measurement of formation properties during the excavation of the hole, or shortly thereafter, through the use of tools integrated into the BHA 124. LWD measures properties of a formation before drilling fluids invade deeply. Further, many wellbores prove to be difficult or even impossible to measure with conventional wireline tools, especially highly deviated wells. In these situations, the LWD measurement ensures that some measurement of the subsurface is captured in the event that wireline operations are not possible.

The first and second embodiments of the BHA 124 include various LWD tools including an isonic tool 312, an Azimuthal Density Neutron ("ADN") tool 316, a DWOB tool, an IMPulse tool 306, and possibly other tools. The isonic tool 312 uses acoustic energy to seismically characterize the formation. The ADN tool 316 has neutron and gamma-ray sources that are attached with a titanium rod to a flashing head to make azimuthal density and photoelectric factor measurements. Other embodiments could use LWD tools such as a resistivity-at-the-bit (RAB) tool, a GeoVISION tool, a Fullbore Formation MicroImager ("FMI"), etc.

MWD allows transport of telemetry from the BHA 124 gathered in the LWD process. The evaluation of physical properties, usually including pressure, temperature and wellbore trajectory in three-dimensional space, while extending a wellbore. The measurements are made downhole, stored in solid-state memory for some time and later transmitted to the surface. Data transmission methods involve digitally encoding data and transmitting to the surface as pressure pulses in the mud system. These pressures may be positive, negative or continuous sine waves. Some MWD tools have the ability to store the measurements for later retrieval with wireline or when the tool is tripped out of the hole if the data transmission link fails. The first embodiment 124-1 uses a PowerPulse tool to send MWD telemetry at 12 bits/sec., and the second embodiment 124-2 uses the IMPulse combination tool that includes the MWD telemetry function.

Figure 4:
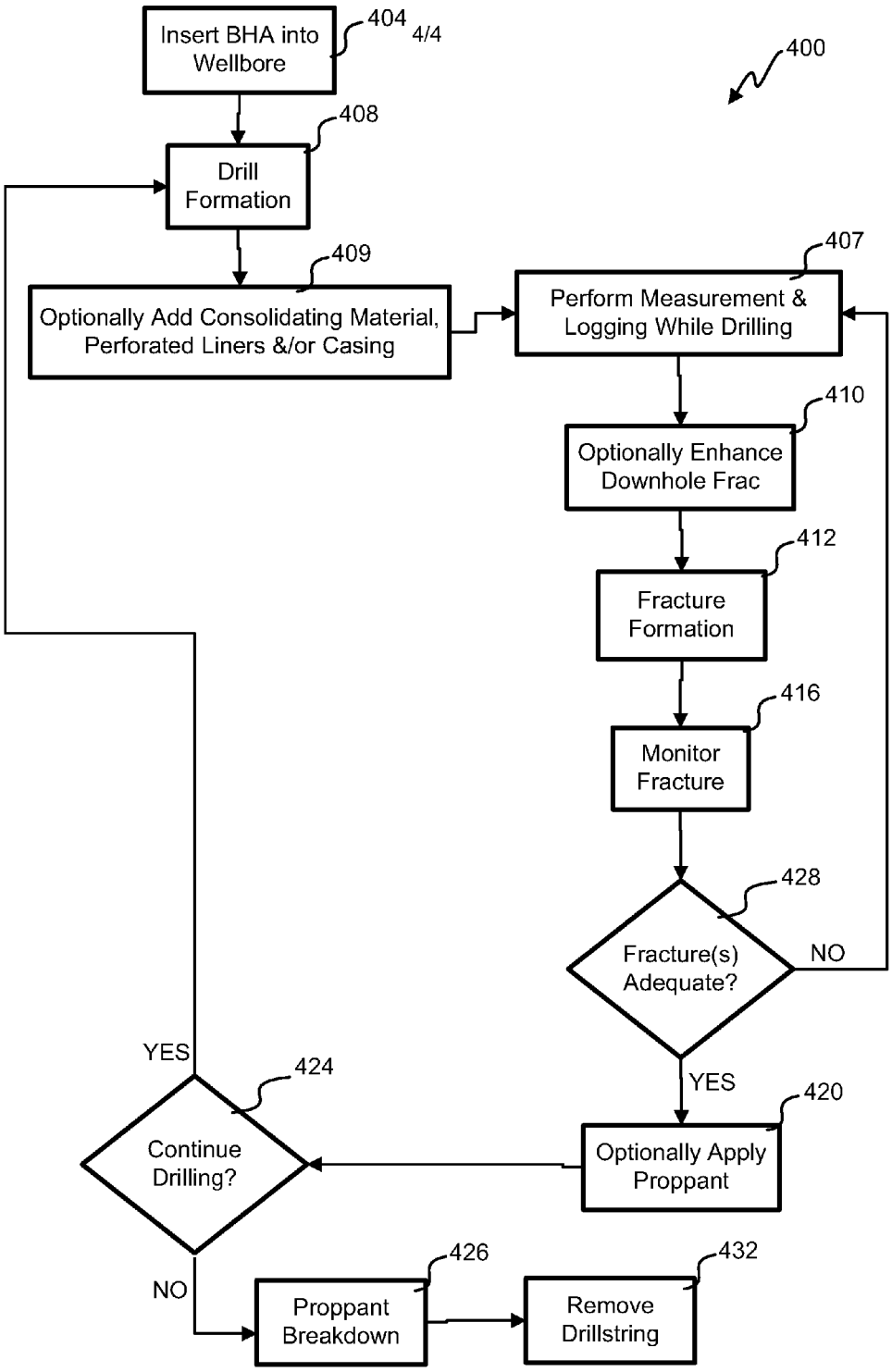
FIG. 4 illustrates a flowchart of an embodiment of a process for fracturing while drilling.

With reference to FIG. 4, a flowchart of an embodiment of a process 400 for fracturing while drilling is shown. The depicted portion of the process 400 starts in block 404 where the BHA 124 is inserted into the wellbore. Drilling of the formation is performed in block 408, but may continue throughout the process 400 until the drillstring is removed in block 432 in some embodiments. Other embodiments may stop drilling for fracturing, consolidating, casing and/or lining but in any event, the BHA 124 is not removed from the borehole to perform one or more of these processes.

In high permeability formations, such as those in the many offshore environments, the formations may not have sufficient rock strength to be completed as a barefoot or open hole completion. In these types of reservoirs, the formation may be consolidated in block 409 before the wellbore can be fracture-stimulated in accordance with an embodiment of the present invention. Plastics and various resins may be used to consolidate and strengthen high permeability formations. In certain aspects of the present invention, the consolidation step in such wells, may simply add one more step to the method of an embodiment of the present invention. In an aspect of the present invention, the consolidating material may be placed into/onto the formation behind the drill bit 120 in the wellbore and allowed to cure and set. In such an aspect, the fracture stimulation process may then take place through this consolidated borehole.

In some reservoir lithologies, the rock may have sufficient strength such that it may not be necessary to support the drilled hole with casing 108 and/or cement. These wells may be produced as an open hole completion, but often these wells use pre-drilled (pre-perforated) or slotted liners as the completion string to provide insurance against small areas of hole collapse. In other cases, casing 108 may be run with external packers that help isolate flow from various intervals and may allow for selective stimulation. Insertion of slotted liners and/or casing can be optionally performed in block 409. In these scenarios, embodiments of the present invention may provide for single trip drilling, stimulating and completing. Insertion of the liners or casing can be done before removal of the drill string from the wellbore. Additionally, these processes can be done periodically for the wellbore or all at once.

In block 407, various LWD gathers information on the formation and it is relayed to the surface as telemetry in the MWD process. At the surface, that information is processed to control the frac process. In block 410, an enhancement to the frac process can be put in place. There are various downhole fracture enhancers 256 described throughout this description to amplify the frac process. The fracture actuator 212 can initiate the fracture formation by whatever frac enhancement mechanisms are available, for example, valves to create pressure, explosive charges or mechanical perforation devices.

Fracturing of the formation takes place in block 412. Monitoring of the fracturing is performed in block 416 to provide feedback to know when fracturing is finished. Until it is determined in block 428 that the fracturing is finished to some level of satisfaction, processing loops back to block 410. Although blocks 407, 410, 412, 416, and 428 are shown as sequential, they can be performed simultaneously in a closed loop fashion.

When adequate fracturing is completed for this portion of the wellbore as determined in block 428 processing continues to block 420 to optionally perform proppant steps that can serve to fill prior fractures 112 and focus effort on growing new fractures 116. Any proppant is applied in block 420, for example, through pumping sealing fluid into the annulus. If drilling is continuing as determined in block 424, processing loops back to block 408 to increase the length of the wellbore. In block 426, the proppant can be broken down automatically or by use of some catalyst to assist in the break down after drilling is complete or sealant is no longer desired for the fractures 112. Once drilling is complete, the drillstring is removed in block 432.

In some embodiments of the present invention, the FWD may comprise drilling and fracturing at least every few feet (e.g., every x feet, where x is an integer between one and ten). In certain aspects of the present invention, the drilling fluid may be circulated out of the wellbore, a section of the wellbore and/or the like, and proppant may be pumped into the wellbore, a section of the wellbore or the like when fracturing. In other aspects, drilling and fracturing may be performed using a proppant loaded drilling fluid.

In some embodiments, to prevent subsequent fluid loss, to minimize subsequent damage to the already created fracture and/or the like, a screenout may be performed at the end of the job by ramping up the fiber and or other solids concentration. By screening out, the stress field around the fracture may be increased, minimizing the likelihood of the fracture opening during subsequent fracturing processes. Furthermore, the near wellbore region of the fracture may be packed with a degradable solid, a mixture of degradable solids or the like that may temporarily act as a hydraulic seal and protect the fracture from exposure to drilling fluids in subsequent operations. Completely degradable polylactic acid fiber may be used in this application. Additionally, polylactic acid emulsion or the like may be used as a clean fluid loss pill or the like to seal prior fractures 112. In yet other aspects or in combination with the preceding, a mixture of polylactic acid and calcium carbonate may be used. In still yet other aspects, encapsulated or naked rock salt may be used in a saturated salt solution.

In certain embodiments, the fracturing fluid may contain esters, solvents, acids, that may help remove the near wellbore damage caused by the drilling fluid and plugging agents. As mentioned previously, acid soluble fibers and filtercake additives comprising sized calcium carbonates, mixed polylactic acid, carbonates and/or the like may be used at the tail end of the fracturing treatment to seal the fracture. Clean drilling fluid may be pumped down the drill pipe 104 to protect the BHA 124 and proppant loaded frac fluid may be down the annulus 128.

In some embodiment of the present invention, the FWD may comprise fracturing down the annulus 128. In such embodiments, the BHA 124 may be protected with a slug of polylactic acid fiber. Furthermore, circulation may be reversed prior to the treatment by screen out with a fiber plug against the BHA 124. This plug may be removed by circulating a caustic solution.

Embodiments of the present invention may be used in coiled tubing drilling with management of the requisite surface pressures. In embodiments comprising fracturing while coiled tubing drilling, where fluids (such as fracturing fluids are pumped down the annulus 128), the collapse pressure of the coil may be monitored, managed, addressed and/or the like. Embodiments of the present invention may be used with wireline lateral drilling ("WILD") drilling techniques or the like. In such embodiments, the jacks of the tractor may be to set tension on the formation to change the local stress and control fracturing location.

Embodiments of the present invention may be used with/in casing drilling. In such embodiments, drilling, stimulating and casing 108 may be provided in a single operation (i.e., without removal of the drill string). In certain aspects, the casing 108 may be cemented and may provide borehole support across small areas of collapse. When conventional casing 108 is run, the casing 108 may need perforating across the fracture stimulated zone. In aspects of the present invention, the cement may provide wellbore integrity and may include external casing packers. Alternative materials such as gels or particles may be used as replacements for conventional cement in some embodiments and may provide wellbore isolation in the annulus 128. The particles may be gravel, as is used in sand control treatments, which would be placed as a high rate water pack treatment as is done in long horizontal gravel pack treatments. Alternatively, shunt tubes may be placed on the casing 108 to help insure placement of the gravel along the entire length of the casing 108.

In some embodiments, to avoid the need to perforate afterwards, acidizable plugs may be in the casing 108, and acidizable cement may be pumped as the tail of the cement slurry. Such embodiments, may allow access to the formation and fractures 112 by placing acid in the casing 108. Acid may be pumped behind the cement plug and may allow the well to be brought straight onto production after the acid soak.

In an embodiment of the present invention, during the fracturing operation the differential pressure between the well and the formation may be large and may cause stick slip. As such, in various embodiments of the present invention, the drill string may be rotated during the fracturing operation. In other aspects, during the fracturing operation there may be a high flow rate of proppant loaded fluids around the BHA 124 into the fracture, which may cause erosion of the BHA 124. As such, in some embodiments of the present invention, the BHA 124 may slide or rotate to provide that the same location of the BHA 124 is not eroded all of the time. In some embodiments, a hard coating may be put on the BHA 124 to reduce erosion. In some embodiments, drilling may take simultaneously with fracturing.

In embodiments of the present invention, FWD may be combined with drilling techniques, including electric arc, electric discharge drilling, dissolution drilling or the like. In further embodiments, electric arc, electric discharge drilling, dissolution or the like may be used to provide fracture initiation locations, for electric discharge drilling may be used in the location planned for fracturing and may provide for will roughen the surface and helping to nucleate more fractures 112.

Specific details are given in the above description to provide a thorough understanding of the embodiments. However, it is understood that the embodiments may be practiced without these specific details. For example, circuits or systems may be shown in block diagrams in order not to obscure the embodiments in unnecessary detail. In other instances, well-known circuits, processes, algorithms, structures, and techniques may be shown without unnecessary detail in order to avoid obscuring the embodiments.

While the principles of the disclosure have been described above in connection with specific apparatuses and methods, it is to be clearly understood that this description is made only by way of example and not as limitation on the scope of the disclosure.

What is claimed is:

1. A method for preparing a formation surrounding a wellbore to bear hydrocarbons, the method comprising steps of:

drilling the wellbore with a bottomhole assembly;

increasing a pressure of a fluid in at least a section of the wellbore while the bottomhole assembly is in the wellbore;

fracturing the formation appurtenant to the wellbore to create one or more fractures;

analyzing the one or more fractures;

propping the one or more fractures with a sealing proppant which temporarily has low permeability and subsequently increases in permeability;

performing further fracturing to create another fracture based upon the analyzing step; and further drilling the wellbore with the bottomhole assembly, wherein the steps listed between the two drilling steps occur in time between the two drilling steps without pulling the bottomhole assembly out of the wellbore and the sealing proppant increases in permeability after creation of said another fracture.

2. The method for preparing the formation surrounding the wellbore to bear hydrocarbons as recited in claim 1, further comprising a step of simultaneously drilling a wellbore and fracturing a formation surrounding the wellbore.

3. The method for preparing the formation surrounding the wellbore to bear hydrocarbons as recited in claim 1, further comprising a step of adding consolidating material into the wellbore to consolidate the formation, after the first said drilling step and before the fracturing step.

4. The method for preparing the formation surrounding the wellbore to bear hydrocarbons as recited in claim 1, further comprising a step of casing the wellbore, wherein the casing step is performed without pulling more than a few joints of drill or casing pipe out of the wellbore.

5. The method for preparing the formation surrounding the wellbore to bear hydrocarbons as recited in claim 1, wherein the propping step is performed after the analysis step concludes the one or more fractures are adequate.

6. The method for preparing the formation surrounding the wellbore to bear hydrocarbons as recited in claim 1, wherein the drilling is performed coextensive in time to the fracturing.

7. The method for preparing the formation surrounding the wellbore to bear hydrocarbons as recited in claim 1, wherein locations for applying fracturing are controlled with feedback information gathered in the borehole.

8. The method for preparing the formation surrounding the wellbore to bear hydrocarbons as recited in claim 1, wherein:

a tracer is added to the fluid, and the analyzing step is enhanced with the tracer.

9. The method for preparing the formation surrounding the wellbore to bear hydrocarbons as recited in claim 1, wherein:

the analyzing step includes a sub-step of determining the extent of the one or more fractures;

the step of performing further fracturing based upon the analyzing step is performed at a different location of the well bore from the said one or more fractures.

10. A method for preparing a formation surrounding a wellbore to bear hydrocarbons, the method comprising steps of:

drilling the wellbore with a bottomhole assembly;

increasing a pressure of a fluid in at least a section of the wellbore while the bottomhole assembly is in the wellbore, wherein the section is pressure isolated from another section of the wellbore;

perforating the formation with one or more perforations;

fracturing the formation appurtenant to the wellbore and proximate to the one or more perforations to create one or more fractures, wherein locations for applying fracturing are controlled with feedback information gathered in the borehole from one or more sensors;

analyzing the one or more fractures with information from the one or more sensors;

propping the fracture with a sealing proppant which temporarily has low permeability and subsequently increases in permeability;

performing further fracturing to create another fracture based upon the analyzing step;

casing the wellbore, and drilling the wellbore with the bottomhole assembly, wherein the steps listed between the two drilling steps occur in time between the two drilling steps without pulling the bottomhole assembly out of the wellbore and the sealing proppant increases in permeability after creation of said another fracture.

11. A method for preparing a formation surrounding a wellbore to bear hydrocarbons, the method comprising steps of:

drilling the wellbore with a bottomhole assembly;

increasing a pressure of a fluid in at least a section of the wellbore while the bottomhole assembly is in the wellbore;

fracturing the formation appurtenant to the wellbore to create one or more first fractures;

analyzing the one or more fractures;

propping the one or more first fractures such that they remain under stress which inhibits reopening of the one or more first fractures;

controlling fluid loss through the one or more first fractures further drilling the wellbore with the bottomhole assembly, before or after further drilling, but after controlling fluid loss through the one or more first fractures, performing further fracturing with feedback from the analyzing step to create one or more further fractures sufficiently spaced from the one or more first fractures to allow fracturing despite the said stress applied to the one or more first fractures;

wherein the steps of fracturing to create one or more first fractures, controlling fluid loss and further fracturing are carried out without pulling the bottomhole assembly out of the wellbore.

12. The method of claim 11, wherein the analyzing step includes a sub-step of determining the extent of the one or more fractures.

13. The method of claim 12, wherein the analyzing step is carried out by microseismic fracture monitoring.

14. The method of claim 11, wherein controlling fluid loss through the one or more first fractures is by placing proppant therein, said proppant initially being of low permeability but subsequently increasing in permeability.

15. The method of claim 11, further comprising a step of adding consolidating material into the wellbore to consolidate the formation, after the first said drilling step and before the fracturing step.

16. The method of claim 11, wherein the drilling is performed coextensive in time to the fracturing.

17. The method of claim 11, wherein locations for applying fracturing are controlled with feedback information gathered in the borehole.

18. The method of claim 11, wherein a tracer is added to the fluid, and the analyzing step is enhanced with the tracer.

19. The method of claim 11, wherein the formation is selected from shale and a coal bed and wherein the hydrocarbons are gaseous.

* * * * *